US011675292B2

(12) United States Patent
Sato

(10) Patent No.: US 11,675,292 B2
(45) Date of Patent: Jun. 13, 2023

(54) IMAGE FORMING APPARATUS

(71) Applicant: CANON KABUSHIKI KAISHA, Tokyo (JP)

(72) Inventor: Koki Sato, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/722,472

(22) Filed: Apr. 18, 2022

(65) Prior Publication Data

US 2022/0357694 A1 Nov. 10, 2022

(30) Foreign Application Priority Data

May 7, 2021 (JP) ..... JP2021-079306

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2006/0280530 A1* 12/2006 Andoh ..... G03G 15/0194 399/301

FOREIGN PATENT DOCUMENTS

JP 2004-359441 A 12/2004

* cited by examiner

*Primary Examiner* — Victor Verbitsky
(74) *Attorney, Agent, or Firm* — Venable LLP

(57) ABSTRACT

An image forming apparatus includes a transfer unit, a fixing unit, a reverse rotary member pair, a first conveyance path, a second conveyance path, an opening and closing member, a first guide member, a second guide member, and a dividing member. The second guide member is supported by the opening and closing member and forms an inserted portion where a case of the fixing unit is inserted and one side of guide surfaces of the second conveyance path. The second guide member forms one side of guide surfaces of the first conveyance path in a state where the opening and closing member is in a closed position. The dividing member, in the state where the opening and closing member is in the closed position, divides a gap formed between the second guide member and the case inserted into the inserted portion from the second conveyance path.

14 Claims, 7 Drawing Sheets

IMAGE FORMING APPARATUS

BACKGROUND OF THE INVENTION

Field of the Invention

This disclosure relates to an image forming apparatus including a fixing unit for fixing an image by heating a sheet, and a conveyance path for guiding a reversed sheet to a transfer portion.

Description of the Related Art

For example, in a laser beam type image forming apparatus such as a printer, a facsimile, and a multifunction machine, after a toner image has been transferred onto a sheet, a fixing unit heats and presses the image so as to fix the image on the sheet. Further, for example, in a case performing a duplex printing, the sheet on whose surface the image has been fixed was conveyed to a reverse conveyance roller, and, after a conveyance direction of the sheet has been reversed so as to convey the sheet to a transfer portion again via a reconveyance path, the image is formed on a back surface of the sheet. That is, this kind of the image forming apparatus includes a main conveyance path for discharging the sheet outside of the apparatus by passing the sheet across the fixing unit from the transfer portion, and the reconveyance path for reconveying the sheet from the reverse conveyance roller to the transfer portion.

Incidentally, sometimes, clogging with the sheet, a so-called jam, occurs in the main or reconveyance path. Therefore, there is an image forming apparatus in which two guide members are supported by a cover, which is openable with respect to an apparatus body, so as to make the main and reconveyance paths openable by opening the cover (refer to Japanese Patent Laid-Open No. 2004-359441). The image forming apparatus suggested by Japanese Patent Laid-Open No. 2004-359441 includes a concave portion in an outer guide member in the opening direction for inserting part of the fixing unit in a state where the cover is closed. Then, an opening portion is formed in the concave portion so as to make it possible to visually confirm the absence and presence of the sheet in the reconveyance path in a state where the two guide members are opened.

However, the sheet including, for example, paper and the like contains water, and, since the water is released from the sheet when the fixing unit performs heating, a large amount of a water vapor is released inside of the fixing unit and in a conveyance path disposed downstream of the fixing unit in the sheet conveyance direction. When such a water vapor flows into the reconveyance path, since, in particular, a guide member forming the reconveyance path is close to the outside of the apparatus and a low temperature, dew condensation easily occurs. Then, when the sheet is conveyed to the reconveyance path in which the dew condensation has occurred, the sheet jam easily occurs, and it is possible that a water droplet attached to the sheet causes image defects and generates density unevenness of the image. Therefore, while it is desired to prevent an inflow of the water vapor, in particular, to the reconveyance path, if, as described in Japanese Patent Laid-Open No. 2004-359441, it is configured such that it is possible to visually confirm the absence and presence of the sheet in the reconveyance path in the state where the two guide members are opened, since the fixing unit and the reconveyance path communicate with each other, there is a problem that the water vapor easily flows into the reconveyance path.

Thus, it is an object of this disclosure to provide the image forming apparatus capable of reducing the amount of the water vapor flowing into the reconveyance path from the fixing unit.

SUMMARY OF THE INVENTION

According to a first aspect of the present invention, an image forming apparatus includes a transfer unit configured to transfer an image onto a sheet, a fixing unit including a fixing rotary member pair configured to fix the image transferred by the transfer unit by heating the sheet, and a case housing the fixing rotary member pair, a reverse rotary member pair disposed downstream of the fixing unit in a sheet conveyance direction, and capable of reversing and conveying the sheet, a first conveyance path configured to guide the sheet from the fixing unit to the reverse rotary member pair, a second conveyance path configured to guide the sheet reversed by the reverse rotary member pair to the fixing unit, an opening and closing member supported in a manner swingable to a closed position closed with respect to an apparatus body and to an opening position opening the first conveyance path, a first guide member supported by the opening and closing member to form one side of guide surfaces of the second conveyance path, a second guide member supported by the opening and closing member, the second guide member forming an inserted portion where the case is inserted and another side of the guide surfaces of the second conveyance path, the second guide member forming one side of guide surfaces of the first conveyance path in a state where the opening and closing member is in the closed position, the second guide member being configured to allow visual recognition of the second conveyance path via the inserted portion in a state where the opening and closing member is in the opening position, and a dividing member, in the state where the opening and closing member is in the closed position, dividing a gap formed between the second guide member and the case inserted into the inserted portion from the second conveyance path.

Further features of the present invention will become apparent from the following description of exemplary embodiments with reference to the attached drawings.

DESCRIPTION OF THE EMBODIMENTS

Figure 1:
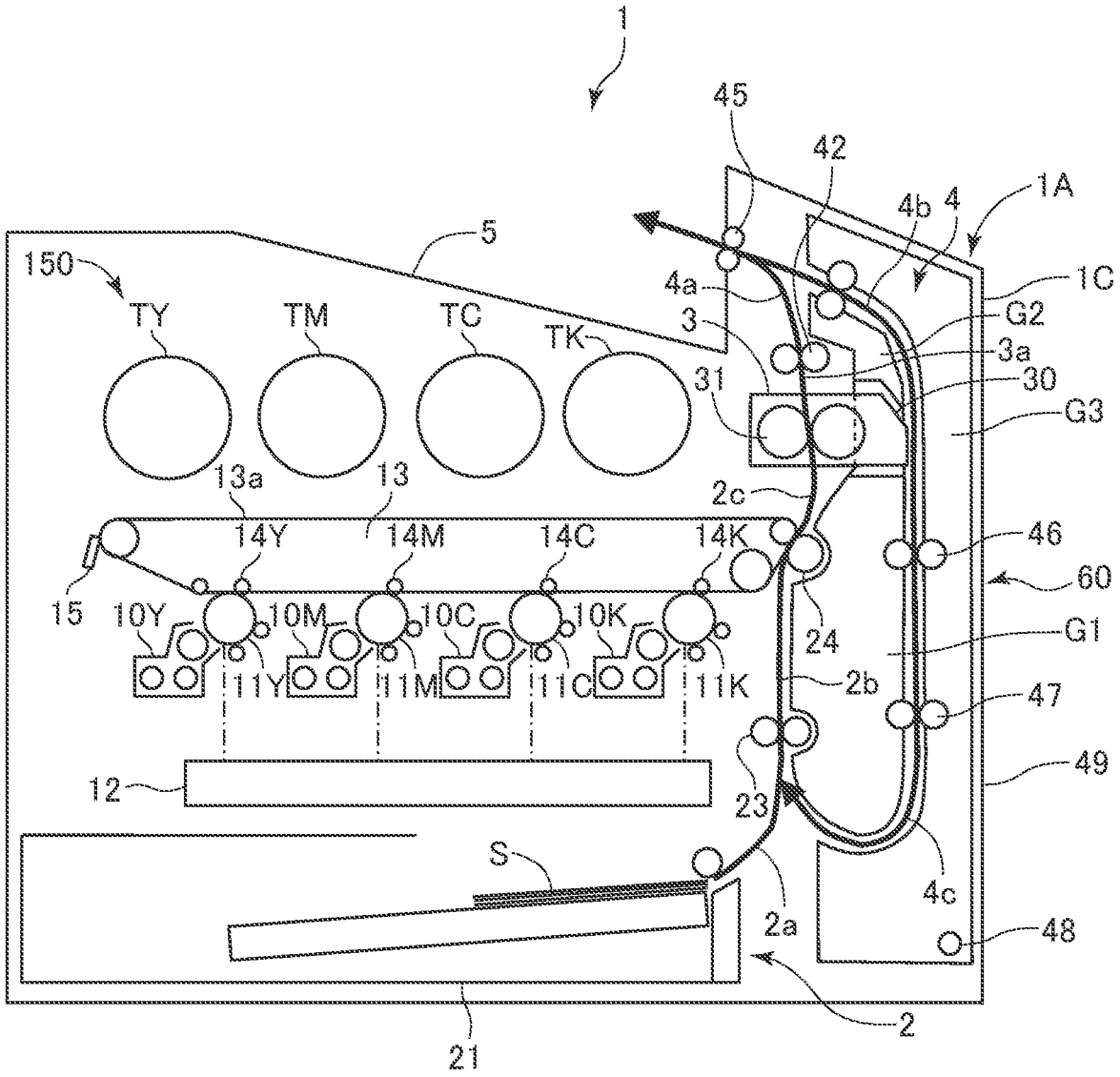
FIG. 1 is a schematic cross-sectional view showing an entire image forming apparatus relating to this embodiment.

Hereinafter, referring to the drawings, an image forming apparatus relating to this embodiment will be described. The image forming apparatus includes a printer, a copier, a facsimile, and a multifunction machine, and forms an image on a sheet used as a recording material based on image information input from an external personal computer (PC) and the image information read from a document. The sheet used as the recording material includes paper such as standard paper and cardboard, a plastic film such as a sheet for an overhead projector, a specially shaped sheet such as an envelope and an index sheet, and cloth.

Configuration of Image Forming Apparatus

FIG. 1 is a schematic cross-sectional view showing the entire image forming apparatus 1 relating to this embodiment. The image forming apparatus 1 that is a full color laser printer includes, inside an apparatus body 1A, an image forming unit 150, a sheet feeding unit 2, a fixing unit 3, serving as a fixing unit, toner storage units T (TY, TM, TC, and TK), and a reverse discharge unit 4. Further, the image forming apparatus 1 includes a sheet stacking portion 5 on an upper surface of the apparatus body 1A. To be noted, it is acceptable to configure the multifunction machine by disposing the document reading apparatus on an upper part of the apparatus body 1A.

The image forming unit 150 is included in the image forming apparatus 1. The image forming unit 150 forms four colors of toner images of yellow (Y), magenta (M), cyan (C), and black (K). That is, the image forming unit 150 is an electrophotographic unit of a so-called intermediate transfer tandem type in which four photosensitive drums 11 (11Y, 11M, 11C, and 11K) are disposed along an intermediate transfer belt 13*a* of an intermediate transfer unit 13. To be noted, toners of yellow (Y), magenta (M), cyan (C), and black (K) are respectively stored in the toner storage portions T (TY, TM, TC, and TK).

The image forming unit 150 includes the photosensitive drums 11 (11Y, 11M, 11C, and 11K), serving as a photosensitive member, the intermediate transfer unit 13, primary transfer rollers 14 (14Y, 14M, 14C, and 14K), and a secondary transfer roller 24. Developing units 10 (10Y, 10M, 10C, and 10K) for developing the toner image are disposed around the respective photosensitive drums 11 (11Y, 11M, 11C, and 11K).

The photosensitive drum 11 is irradiated with a laser beam from an exposing unit 12 disposed below. When an image forming process is started, the laser beam is irradiated from the exposing unit 12 to a surface of the photosensitive drum 11 whose surface has been uniformly charged by a charge device, not shown, beforehand, and the surface of the photosensitive drum 11 is exposed. At this time, the exposing unit 12 has received a signal (video signal) corresponding to the image data for printing, and irradiates the photosensitive drum 11 with the laser beam modulated corresponding to the video signal via a scanning optical system including a polygon mirror. Thereby, an electrostatic latent image corresponding to the image data is formed on the drum surface.

The developing unit 10 supplies the toner to the electrostatic latent image formed on the photosensitive drum 11, and visualizes (develop) the electrostatic latent image. Thereafter, as the primary transfer roller 14 provides a predetermined pressing force and electrostatic load bias, the toner image is primarily transferred from the photosensitive drum 11 to the intermediate transfer belt 13*a*. To be noted, a residual toner remained on the photosensitive drum 11 after the primary transfer is collected by a cleaning unit, not shown, and the surface of the photosensitive drum 11 is cleaned.

Toner image forming operations described above are proceeded in parallel in the respective photosensitive drums 11. Further, the toner image formed on the photosensitive drum 11 is primarily transferred to the intermediate transfer belt 13*a*, which is rotatably driven, by the primary transfer roller 14 in such a manner that the toner image formed on the photosensitive drum 11 on a downstream side is superimposed on the toner image formed on the photosensitive drum 11 on an upstream side. Thereby, a full color toner image is eventually formed on the intermediate transfer belt 13*a*, and conveyed to the secondary transfer roller 24 while being borne by the intermediate transfer belt 13*a*. The secondary transfer roller 24 transfers the toner image from the intermediate transfer belt 13*a* onto the sheet S while nipping and conveying the sheet S. To be noted, a residual toner remained on the intermediate transfer belt 13*a* after the secondary transfer is collected by a cleaning unit 15, and the surface of the intermediate transfer belt 13*a* is cleaned.

Thereafter, the sheet S is conveyed to the fixing unit 3, serving as the fixing unit fixing the toner image by heating and pressing the toner image. The fixing unit 3 includes a fixing roller pair 31 that is a fixing rotary member pair. The fixing roller pair 31 includes a fixing film 31*a*, serving as a heating rotary member incorporating a heating heater, not shown, and a press roller 31*b* pressed toward the fixing film 31*a* (refer to FIG. 3). These fixing film 31*a* and press roller 31*b* provide heat and pressure to the toner image while nipping and conveying the sheet S. Thereby, the toner is melted, and thereafter solidified so as to be fixed on the sheet S, so that the image is fixed on the sheet S.

On the other hand, the sheet S used as the recoding medium is supplied to the image forming unit 150 by the sheet feeding unit 2. The sheet feeding unit 2 include a cassette 21 incorporating a lift up device lifting and lowering while stacking the sheet S, and the sheet S is sent out from the cassette 21 one sheet at a time. The sheet S fed from the cassette 21 is conveyed to a registration roller pair 23 via a conveyance path 2*a*. The registration roller pair 23 corrects the skew of the sheet S, and conveys the sheet S to the secondary transfer roller 24 via a conveyance path 2*b* in the timing determined in accordance with the image forming operation by the image forming unit 150.

The sheet S onto which the toner image has been transferred by the secondary transfer roller 24 is conveyed to the fixing unit 3 via a conveyance path 2*c*. The sheet S on which the image has been fixed by the fixing unit 3 is conveyed by a fixed sheet discharge roller pair 42, serving as a conveyance rotary member pair, via a conveyance path 3*a*, and guided to a conveyance path 4*a* toward a reverse discharge roller pair 45, serving as a reverse rotary member pair. The sheet S reached the reverse discharge roller pair 45 is directly discharged to the sheet stacking portion 5 by the reverse discharge roller pair 45, or, in a case performing duplex printing, is conveyed in a manner reversing a sheet conveyance direction by a reverse operation of the reverse discharge roller pair 45. In the case performing the duplex printing, the reversed sheet S is guided to a reconveyance path 4*b* by a switching flap FL (refer to FIG. 6). The front and back of the sheet S guided to the reconveyance path 4*b* are reversed, and conveyed to a duplex merging conveyance path 4*c* by duplex conveyance roller pairs 46 and 47 so as to reconvey the sheet S to the registration roller pair 23. After the image has been formed on a second surface of the sheet S, which reached the registration roller pair 23, by similar processes performed on the first surface on which the image was formed, the sheet S is discharged to the sheet stacking portion 5.

Configuration of Fixing Unit

Figure 2:
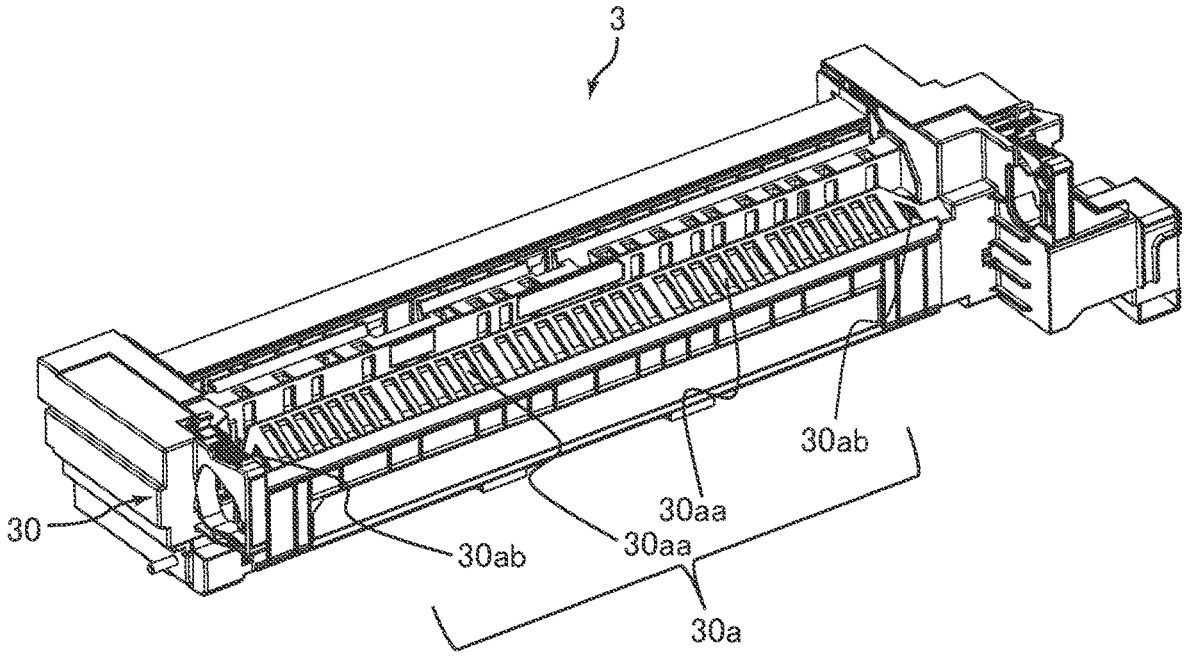
FIG. 2 is perspective view showing a fixing unit relating to this embodiment.
Figure 3:
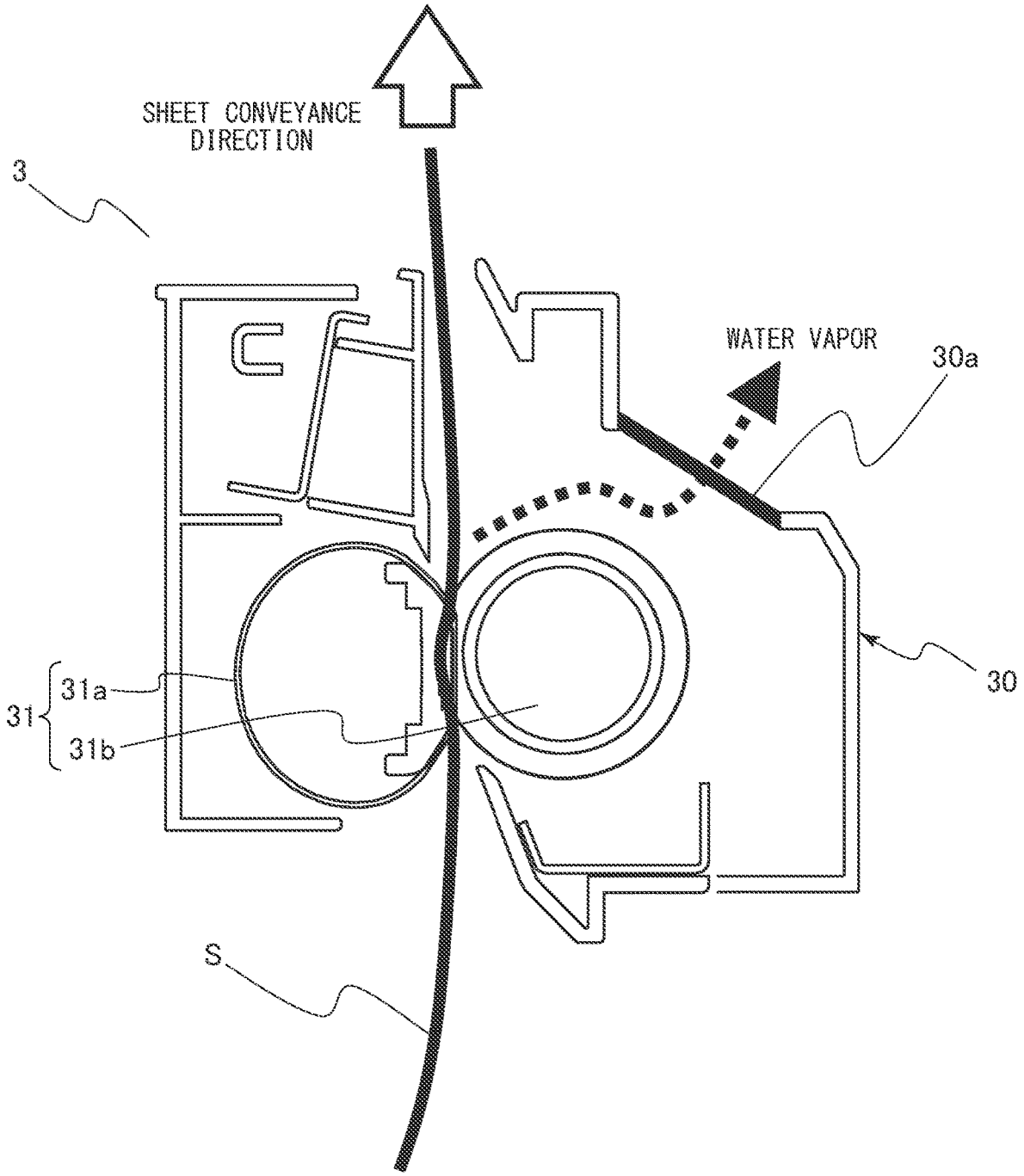
FIG. 3 is a cross-sectional view showing the fixing unit relating to this embodiment.

Next, using FIGS. 2 and 3, a configuration of the fixing unit 3 will be described. As shown in FIGS. 2 and 3, the fixing unit 3 includes a case 30, serving as a housing, and houses the fixing roller pair 31, including the fixing film 31*a* and the press roller 31*b* described above, in an inner space of the case 30. These fixing film 31*a* and press roller 31*b* come into contact with each other in a width larger than a width of the sheet conveyance path in a width direction orthogonally intersecting with the sheet conveyance direction. That is, this fixing roller pair 31 is brought into a contact state in a full width which is larger than a width of the sheet of the maximum size conveyable by the image forming apparatus 1. Accordingly, the flow of air in the sheet conveyance direction is blocked by a nip formed by bringing the fixing film 31*a* and press roller 31*b* into contact with each other.

At the time of conveying the sheet S by this fixing roller pair 31, the fixing film 31*a* and the press roller 31*b* nip the sheet S so as to apply the heat to the sheet S. In general, the sheet S such as the paper used in the image forming apparatus 1 often stores water by absorbing the moisture in the air. In particular, in a case where the humidity of an operating environment is high, an amount of the water stored in the sheet S tends to become proportionally larger. The water stored in the sheet S is evaporated by applying the heat to the sheet S, and stagnates in the inner space of the case 30. When a water vapor continuously touches an inner surface of the case 30, sometimes, a water droplet attaches to the inner surface of the case 30. If an amount of the water droplet exceeds a certain amount, there is a risk that the water droplet drops or leaks outside of the case 30 so as to induce the occurrence of problems such as failure of an electric system in the image forming apparatus 1 and image defects.

So as to prevent these problems, as shown in FIG. 2, a plurality of through holes 30*a* connecting the inner space of the case 30 with the outside so as to prevent the air from stagnating in the inner space of the case 30 are formed in the case 30 of the fixing unit 3 of this embodiment in parallel in the width direction. That is, these through holes 30*a* include end portion through holes 30*ab* disposed at both ends in the width direction and a plurality of intermediate through holes 30*aa* disposed between the end portion through holes 30*ab* in the width direction. That is, the case 30 includes the intermediate through hole 30*aa*, serving as a first through hole, and the end portion through hole 30*ab*, serving as a second through hole, configured to penetrate through the inner space of the case 30 and the gap da so as to connect the inner space and the gap da to each other. The intermediate through holes 30*aa* and the end portion through holes 30*ab* are disposed such that the longitudinal directions of the intermediate through holes 30*aa* and the end portion through holes 30*ab* are along the conveyance direction, and are disposed in parallel in the width direction orthogonally intersecting with the conveyance direction. In general, when the toner image is fixed on the sheet S by the fixing roller pair 31, the water inside the sheet S moves to a side of the press roller 31*b* by the heating heater inside the fixing film 31*a* as shown in FIG. 3, and is released as the water vapor. Since the water vapor is generated on the side of the press roller 31*b* and goes upward, the plurality of through holes 30*a* are disposed above the press roller 31*b* in the case 30.

Configuration of Conveyance Path, Each Conveyance Guide, and Exterior Cover Unit Next, a sheet conveyance path, the disposition structure of each conveyance guide, and a configuration of an exterior cover unit of the image forming apparatus 1 relating to this embodiment will be described using FIGS. 4 to 6.

Figure 6:
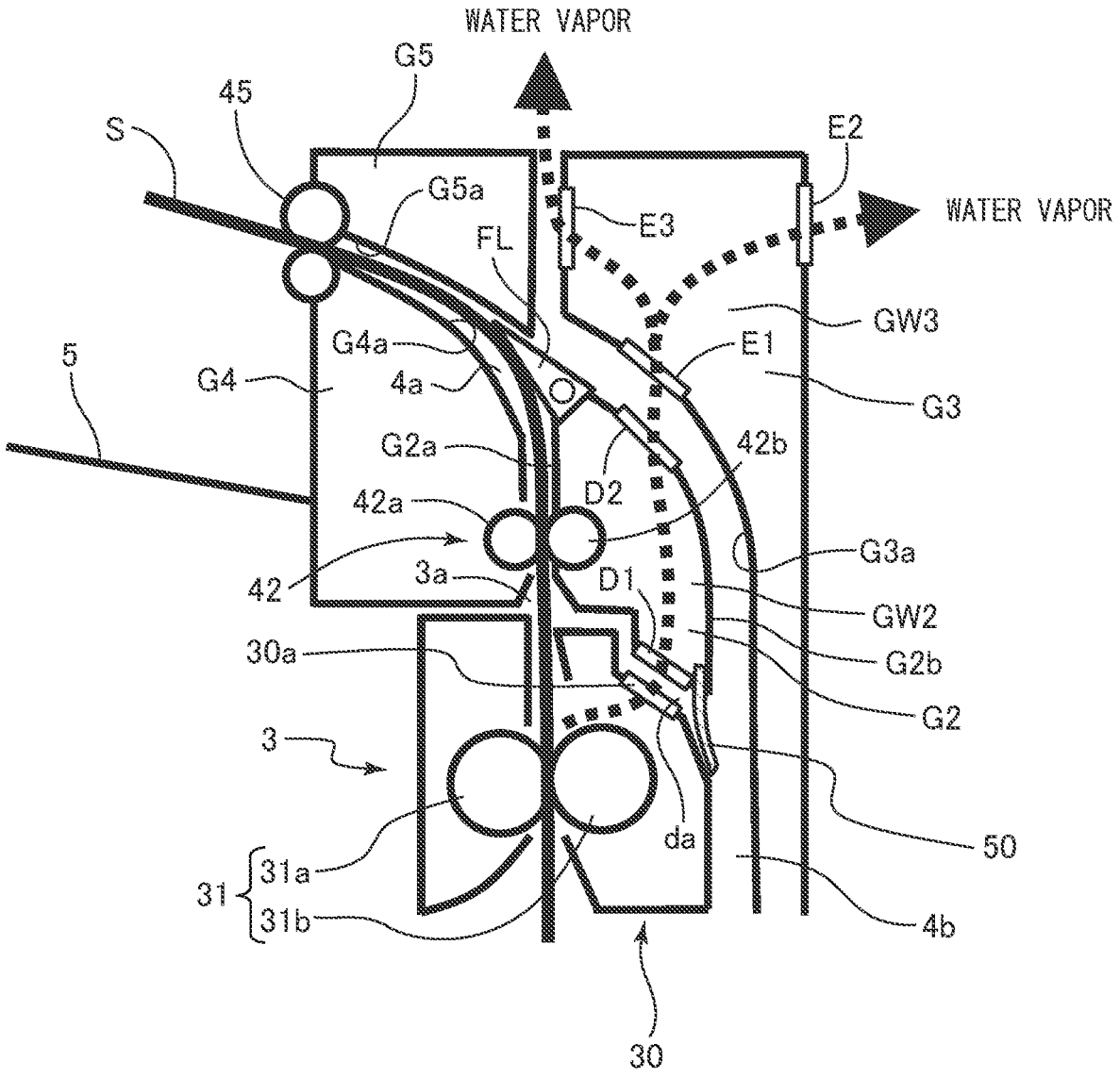
FIG. 6 is a schematic cross-sectional view showing the fixing unit and each conveyance guide relating to this embodiment.

As shown in FIG. 6, on a downstream side of the fixing unit 3 in the sheet conveyance direction, the conveyance path 3*a*, serving as a third conveyance path, the fixed sheet discharge roller pair 42, serving as the conveyance rotary member pair, the conveyance path 4*a*, serving as a first conveyance path, and the reverse discharge roller pair 45, serving as the reverse rotary member pair, are disposed. Further, the reconveyance path 4*b*, serving as a second conveyance path, is disposed between the reverse discharge roller pair 45 and the registration roller pair 23.

To be noted, the fixed sheet discharge roller pair 42 includes a drive roller 42*a* and a driven roller 42*b*. The drive roller 42*a* and driven roller 42*b* each are formed substantially in a shape of one cylindrical column made of, for example, rubber, and both ends of the drive roller 42*a* and driven roller 42*b* are disposed outside of both ends of the conveyance path 3*a*. That is, the drive roller 42*a* and driven roller 42*b* come into contact with each other in a width larger than the width of the sheet conveyance path in the width direction orthogonally intersecting with the sheet conveyance direction. That is, these rollers also come into contact with each other in the full width that is larger than the width of the sheet of the maximum size conveyable by the image forming apparatus 1. Accordingly, the flow of the air in the sheet conveyance direction is blocked by a nip formed by bringing the drive roller 42*a* and driven roller 42*b* into contact with each other.

Figure 4:
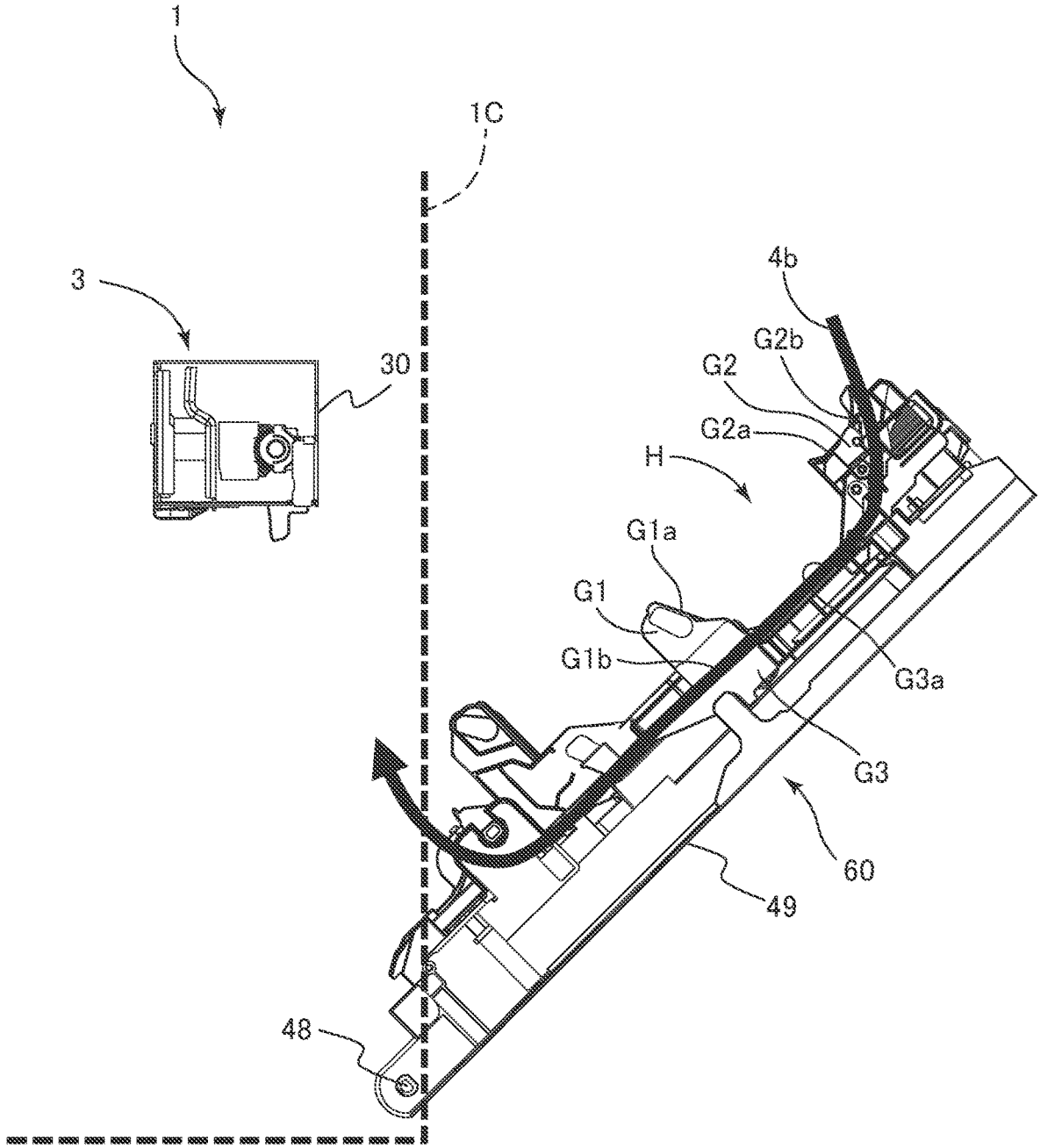
FIG. 4 is a cross-sectional view showing a cover unit and the fixing unit in an opening position relating to this embodiment.
Figure 5:
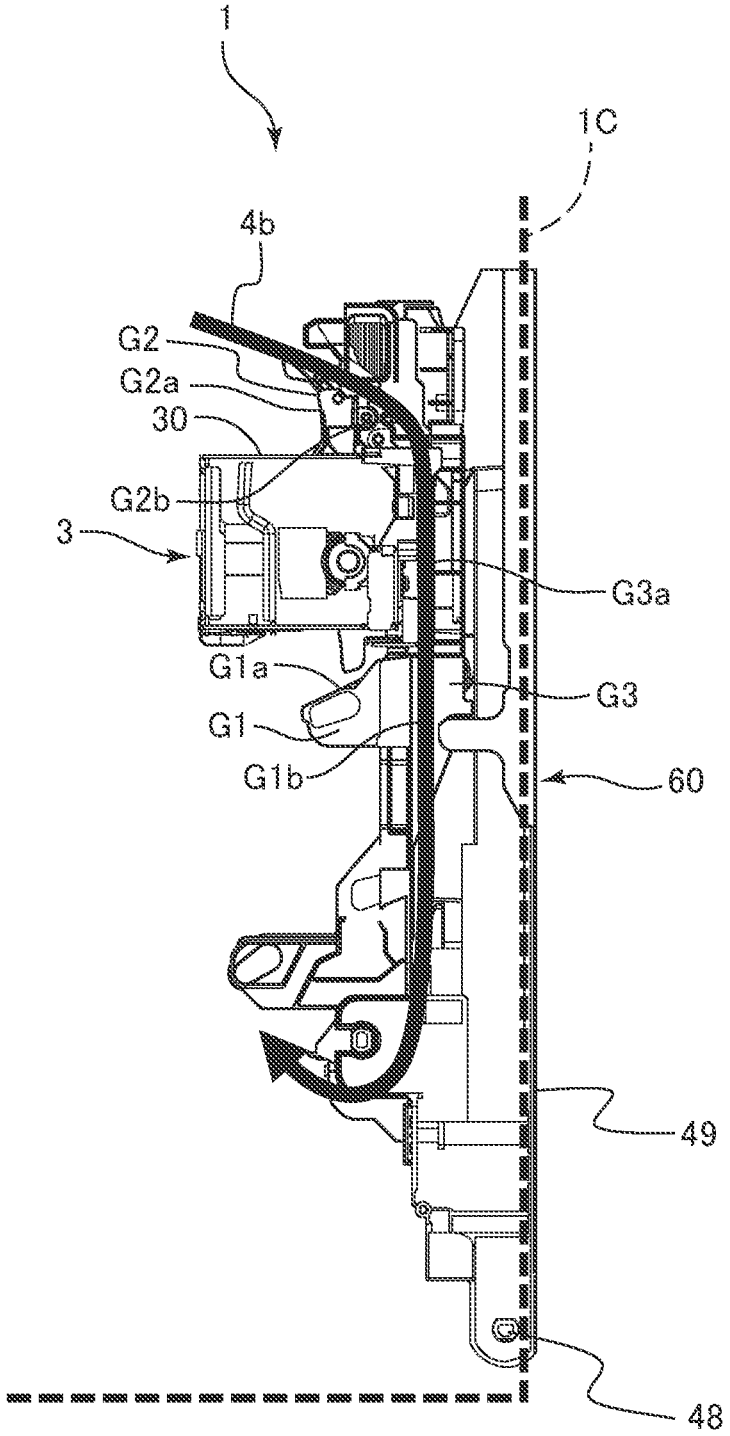
FIG. 5 is a cross-sectional view showing the cover unit and the fixing unit in a closed position relating to this embodiment.

As shown in FIGS. 4 to 6, conveyance guides G1 and G2, integrally serving as a first guide member, are disposed between the conveyance paths 3*a* and 4*a*. The conveyance guide G1 that is a lower guide member is disposed below the fixing unit 3 with clearance. Further, the conveyance guide G2, serving as an upper guide member, is disposed above the fixing unit 3, and a gap da is disposed between the conveyance guide G2 and the fixing unit 3 as clearance. On the other hand, a conveyance guide G3, serving as a second guide member, is disposed in a position facing the conveyance guides G1 and G2 across the reconveyance path 4*b* and inside of an exterior cover 49, serving as an opening/closing member. These conveyance guides G1, G2, and G3 are supported by the exterior cover 49, serving as the opening/closing member, and are included in an exterior cover unit 60. The exterior cover unit 60 is pivotably supported with respect to an exterior cover 1C of the apparatus body 1A by a support shaft 48 pivotably supporting the exterior cover 49. That is, the exterior cover 49 is openable with respect to the exterior cover 1C of the apparatus body 1A.

Further, as shown in FIG. 6, a conveyance guide G4 is disposed on a side of the sheet stacking portion 5 in the horizontal direction of the conveyance guide G2 across the conveyance paths 3*a* and 4*a*. Further, a conveyance guide G5 is disposed above the conveyance guide G4 across the conveyance path 4*a* on the side of the sheet stacking portion 5 in the horizontal direction of the conveyance guide G3.

As shown in FIG. 5, a guide surface G1*a*, serving as one side of the conveyance guide G1 on the side of the sheet stacking portion 5, forms one side of a guide surface of the conveyance path 2*b* (refer to FIG. 1) disposed upstream of the fixing unit 3 in the sheet conveyance direction. Further, as shown in FIG. 6, a guide surface G2*a*, serving as the one side of the conveyance guide G2 on the side of the sheet stacking portion 5, forms the one side of a guide surface of the conveyance path 3*a*, which is disposed downstream of the fixing unit 3 in the sheet conveyance direction and upstream of the fixed sheet discharge roller pair 42 in the sheet conveyance direction. Further, the guide surface G2*a* forms the one side of a guide surface of the conveyance path 4*a* disposed downstream of the fixed sheet discharge roller pair 42 in the sheet conveyance direction. Then, a guide surface G4*a*, serving as an upper side of the conveyance guide G4 on a side of the exterior cover 49 forms the one sides of the guide surfaces of the conveyance paths 3*a* and 4*a*. Further, a guide surface G5*a*, serving as a lower side surface of the conveyance guide G5, forms the other side of the guide surface of the conveyance path 4*a*.

Further, the guide surface G3*a*, serving as the one side of the conveyance guide G3 extending toward the sheet stacking portion 5 from below, forms the one side of a guide surface of the reconveyance path 4*b*. Further, a guide surface G2*b*, serving as the other side of the conveyance guide G2 on the side of the exterior cover 49, forms the other side of the guide surface of the reconveyance path 4*b*. Further, as shown in FIG. 5, a guide surface G1*b*, serving as the other side of the conveyance guide G1 on the side of the exterior cover 49, forms the other side of the guide surface of the reconveyance path 4*b*. To be noted, the guide surfaces of the conveyance guide G1 to G5 described above are not necessarily formed in a plane shape without recesses and projections, and means, in a general term, surfaces, such as a surface connecting vertices of a plurality of ribs, formed so as to guide the sheet S in a manner coming into contact with the sheet S.

Disposition Structure of Fixing Unit and Exterior Cover Unit

Next, a positional relationship between the fixing unit 3 and the exterior cover unit 60, and the formation of the reconveyance path 4*b* with part of the case 30 of the fixing unit 3 will be described. The exterior cover unit 60 is openable with respect to the exterior case 1C of the apparatus body 1A as described above. The exterior cover unit 60 pivots, as shown in FIG. 4, to an opening position opening with respect to the exterior case 1C so as to open the conveyance paths 2*a* and 3*a*, and, as shown in FIG. 5, to a closed position closed with respect to the exterior case 1C.

As shown in FIG. 4, in the exterior cover unit 60, the conveyance guide G3 is disposed on an inner side (closing direction) in an opening/closing direction of the exterior cover 49, and the conveyance guides G1 and G2 are disposed further inside the conveyance guide G3 with a space in between in the vertical direction. Therefore, between the conveyance guides G1 and G2, an opening portion H, serving as an inserted portion into which the part of the fixing unit 3 is inserted, opening to the reconveyance path 4*b* is formed in a concave shape in a cross-sectional view. By opening the exterior cover unit 60 to the opening position, the reconveyance path 4*b* is exposed by the opening portion H, and, in a case where the sheet S is present in the reconveyance path 4*b* due to the occurrence of a jam, it is possible to visually confirm and remove the sheet S.

Then, as shown in FIG. 5, by closing the exterior cover unit 60 to the closing position, the part of the fixing unit 3 fixed to and supported by the apparatus body 1A is inserted into the opening portion H. Thereby, a side surface, which is the part of the case 30 of the fixing unit 3, on the side of the exterior cover 49 forms part of the reconveyance path 4*b*. Since, as described above, the fixing unit 3 is inserted into and extracted from the opening portion H when the exterior cover unit 60 is opened and closed, in a state of the closed position, gaps are required as clearance between the fixing unit 3 and the conveyance guide G1 and between the fixing unit 3 and the conveyance guide G2. However, since, as it is, the gap da (refer to FIG. 6) between the fixing unit 3 and the conveyance guide G2 communicates with the reconveyance path 4*b*, the water vapor released from the through hole 30*a* of the fixing unit 3 enters into the reconveyance path 4*b*, and causes a risk of the occurrence of dew condensation. Therefore, this embodiment is configured as described below.

Configuration of Dividing Member

Next, using FIG. 6, a configuration of a dividing member relating to this embodiment will be described. As described above, the gap da is formed between the fixing unit 3 and the conveyance guide G2. Then, an elastic plate 50, serving as the dividing member dividing the gap da from the reconveyance path 4*b* or serving as a plate-shaped member, is mounted onto a lower part of the conveyance guide G2 on the side of the reconveyance path 4*b*. To be noted, it is not necessary to dispose this elastic plate 50 strictly on a boundary between the gap da and the reconveyance path 4*b*, and it is preferred that the elastic plate 50 is disposed inside of the gap da so as not to obstruct the conveyance of the sheet S through the reconveyance path 4*b*. That is, it is acceptable that the elastic plate 50 divides the gap da itself, or that the elastic plate 50 divides the gap da from the reconveyance path 4*b*.

The elastic plate 50 includes an elastic member, for example, such as rubber, and, in the closed position, is disposed in such a manner that upper and lower ends are respectively brought into contact with the conveyance guide G2 and the case 30 of the fixing unit 3. As described above, the plurality of through holes 30*a* are disposed in the fixing unit 3 in parallel in the width direction, and the elastic plate 50 is disposed before those through holes 30*a* with respect to the reconveyance path 4*b*. That is, the elastic plate 50 divides the gap da between the through holes 30*a* and the reconveyance path 4*b*. Further, the elastic plate 50 is formed so wide that the elastic plate 50 extends to the outside of the end portion through holes ab (refer to FIG. 2) of those through holes 30*a* in the width direction. That is, the elastic plate 50 blocks the gap da by covering approximately the entire gap da in the width direction, and blocks the flow of the air by dividing the gap da from the reconveyance path 4*b*.

Further, as described above, in this embodiment, the elastic plate 50 is the plate-shaped member or sheet member having elasticity. Thereby, it is possible to press the elastic plate 50 hard at the time of bringing the elastic plate 50 into contact with the case 30 of the fixing unit 3. That is, while, in a case where a component not having the elasticity is used instead of the elastic plate 50, if such a component is brought into contact strongly, there is a risk of damaging the case 30 of the fixing unit 3, there is not such a risk by this embodiment.

Figure 7:
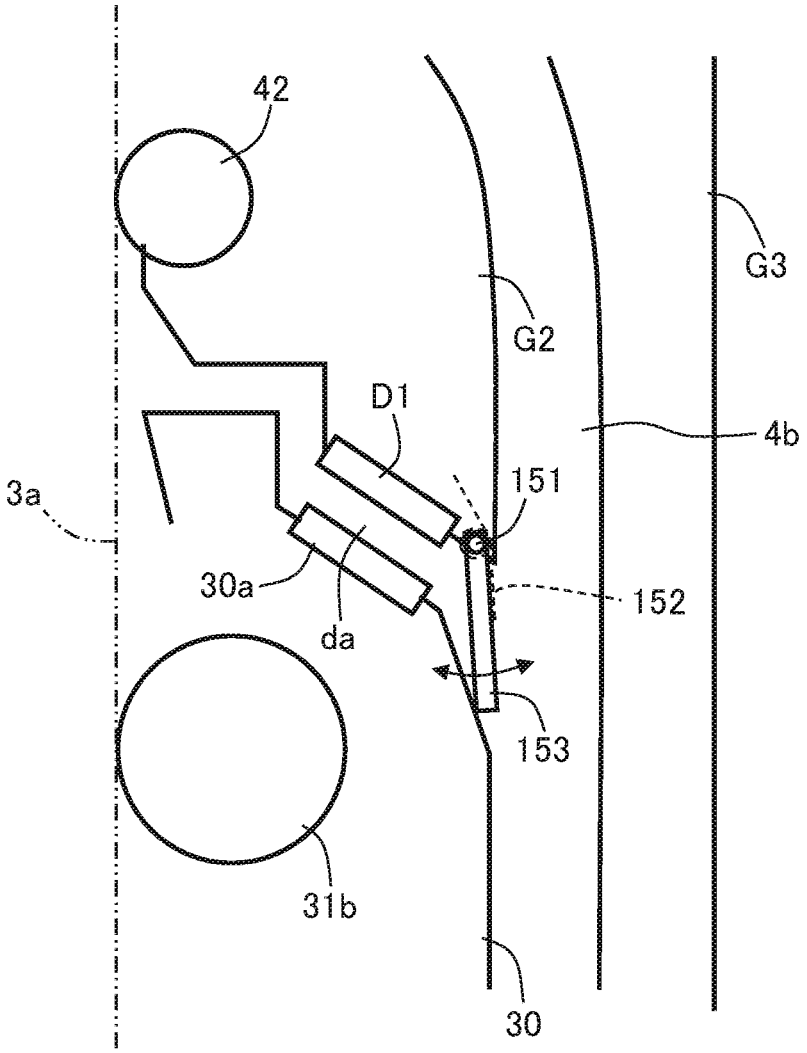
FIG. 7 is a schematic cross-sectional view showing surroundings of a dividing member relating to an alternative example of this embodiment.

To be noted, while, in this embodiment, the elastic plate 50 is mounted onto the conveyance guide G2 for being supported by the conveyance guide G2, mounting onto the case 30 of the fixing unit 3 is acceptable. Further, it is acceptable to support the dividing member by the conveyance guide G2 or the fixing unit 3 so as to make the dividing member swingable to a pivot direction. In this case, it is acceptable to use either an elastic member or a non-elastic member for the dividing member. In a case where the non-elastic member is used for the dividing member, it is conceivable that, by pivotably supporting the dividing member with one of the conveyance guide G2 and the fixing unit 3, and by urging in the pivot direction with a spring and the like, serving as an urging member, the dividing member is pressed to and brought into close contact with the other one of the conveyance guide G2 and the fixing unit 3. For example, as shown in FIG. 7, by supporting the dividing member 153 having non-elasticity by a swing shaft 151 as a center in a swingable manner with respect to the conveyance guide G2, a spring 152 including a torsion coil spring urges the dividing member 153 toward the fixing unit 3. By bringing the dividing member into close contact with the conveyance guide G2, it is possible to suppress the flow of the air from the gap da to the reconveyance path 4*b*.

Flow of Air in Image Forming Apparatus

Next, the flow of the air in the image forming apparatus 1 relating to this embodiment will be described using FIG. 6. As shown in FIG. 6, an opening portion D1, serving as a first opening portion, facing the case 30 of the fixing unit 3 and communicating with the gap da is formed in the lower part of the conveyance guide G2. Further, an opening portion D2, serving as a second opening portion, facing the conveyance guide G3 and communicating with the reconveyance path 4*b* is formed above the opening portion D1 in an upper part of the conveyance guide G2. A ventilation portion GW2, serving as a first ventilation portion, connecting the opening portions D1 and D2 and ventilating from the opening portion D1 to the opening portion D2 is formed inside the conveyance guide G2.

Further, an opening portion E1, serving as a third opening portion, facing the opening portion D2 of the conveyance guide G2 and communicating with the reconveyance path 4*b* is formed in a part of the conveyance guide G3. Then, opening portions E2 and E3, integrally serving as a fourth opening portion, are formed above the conveyance guide G3 in an upper part of the conveyance guide G3, and a ventilation portion GW3, serving as a second ventilation portion, connecting the opening portion E1 to the opening portions E2 and E3 and ventilating from the opening portion E1 to the opening portions E2 and E3 is formed inside of the conveyance guide G3.

In the image forming apparatus 1 relating to this embodiment configured as described above, when the toner image is fixed on the sheet S by the fixing unit 3, a large amount of the water vapor is released from the sheet S to the inside of the case 30 of the fixing unit 3 and to the conveyance path 3*a*. Since the fixing roller pair 31 is a so-called wide nipped roller closely contacting the full width of the sheet, the air containing the water vapor does not flow upstream of the fixing roller pair 31 in the sheet conveyance direction approximately. Here, the so-called wide nipped roller is a roller configured to contact with substantially the entire area of the sheet in the width direction. That is, the width of the fixing roller pair 31 is longer than a width of the widest sheet used in the image forming apparatus 1. Further, since the fixed sheet discharge roller pair 42 is also the so-called wide nipped roller closely contacting in the full width of the sheet, the air containing the water vapor does not flow to the conveyance path 4*a* disposed downstream of the conveyance path 3*a* in the sheet conveyance direction approximately. That is, the width of the fixed sheet discharge roller pair 42 is longer than the width of the widest sheet used in the image forming apparatus 1.

Then, the air containing the water vapor flows from the inside of the case 30 of the fixing unit 3 to the gap da through the through hole 30*a*, and the air containing the water vapor flows also from the conveyance path 3*a* to the gap da. This air containing the water vapor flown into the gap da flows from the opening portion D1 to the inside of the conveyance guide G2 in a manner blocked by the elastic plate 50. Most of this air containing the water vapor flown into the inside of the conveyance guide G2 passes from the opening portion D2 to the inside of the conveyance guide G3 through the opening portion E1, and is released outside the image forming apparatus 1 through the opening portions E2 and E3.

As described above, in the image forming apparatus 1 relating to this embodiment, it is possible to block the gap da formed between the case 30, inserted into the opening portion H in a state where the exterior cover 49 is in the closed position, of the fixing unit 3 and the conveyance guide G2 by the elastic plate 50. Thereby, since the air does not flow from the fixing unit 3 to the reconveyance path 4*b*, it is possible to reduce the amount of the water vapor flowing into the reconveyance path 4*b*. To be noted, while it is obvious that the elastic plate 50 is most effective in a case where the elastic plate 50 comes into completely close contact with the case 30 of the fixing unit 3 and the conveyance guide G2, a slight gap is allowed within the extent that does not hurt effectiveness. It is because the amount of the water vapor flowing into a wide space becomes larger than the amount of the water vapor passing through small clearance.

Further, in the image forming apparatus 1 relating to this embodiment, it is possible to form the part of the guide surface of the reconveyance path 4*b* by inserting the case 30 of the fixing unit 3 into the opening portion H in the state where the exterior cover 49 is in the closed position. Thereby, when the sheet S jams in the reconveyance path 4*b*, it is not only possible to visually confirm the reconveyance path through the opening hole as described in Japanese Patent Laid-Open No. 2004-359441, but also possible to remove the sheet by only putting the exterior cover 49 in a state where the exterior cover 49 is in the opening position.

Further, since the elastic plate 50 is disposed in a width larger than a width in which the plurality of through holes 30*a* are disposed in parallel in the width direction of the fixing unit 3, it is possible to block most of the water vapor released from those through holes 30*a* with respect to the reconveyance path 4*b*.

Then, in this embodiment, the opening portion D1 of the conveyance guide G2 opens to the gap da, and the air blocked by the elastic plate 50 with respect to the reconveyance path 4*b* is released outside of the apparatus by ventilating the air to the conveyance guide G3 via the ventilation portion GW2. Thereby, it is possible to reduce the water vapor flowing into the reconveyance path 4*b*.

Possibility of Other Embodiments

To be noted, while, in this embodiment described above, each of the conveyance guides G1 to G5 includes one conveyance guide member, it is acceptable that each of the conveyance guide members is divided into a plurality of conveyance guides.

Further, in this embodiment, the image forming apparatus 1 includes only the reverse sheet discharge roller pair 45 as a roller for discharging the sheet. However, it is acceptable that, by including the other sheet discharge roller pair, that is, the sheet is discharge from two places, and that further, by including a plurality of sheet discharge roller pairs, the sheet is discharge from equal to or more than three places. In these cases, since the structure of the conveyance paths disposed downstream of the fixed sheet discharge roller pair 42 in the sheet conveyance direction becomes different, a number and a disposition of conveyance guides are changed accordingly.

Further, while, in this embodiment, the air flows from the inside of the fixing unit 3, this means that the air is sucked from any of gaps in the case 30 of the fixing unit 3. Further, not only simply elevating the air by the heat, actively sucking the air or washing the air away by blowing are also acceptable. In this case, a disposition of a blower fan for blowing toward the conveyance path 3*a* and a disposition of a suction fan for sucking the air inside of the conveyance path 3*a* so as to discharge the air outside of the apparatus are conceivable.

Further, while, in this embodiment, the plurality of through holes 30*a* of the fixing unit 3 are disposed in parallel in the width direction, it is not limited to this, and, for example, one slit-shaped through hole and a plurality of through holes lined in a staggered pattern are also acceptable. Further, in the opening portions D1, D2, E1, E2, and E3, it is acceptable that the opening portion is formed by either one opening or by a plurality of openings lined in parallel in a slit-shape. That is, there is no preference in a shape.

By this disclosure, since it is possible to divide the gap between the case of the fixing unit and the second guide member by the dividing member, it is possible to reduce the amount of the water vapor flowing from the fixing unit into the second conveyance path.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-079306, filed May 7, 2021 which is hereby incorporated by reference herein in its entirety.

What is claimed is:

1. An image forming apparatus comprising:

a transfer unit configured to transfer an image onto a sheet;

a fixing unit including a fixing rotary member pair configured to fix the image transferred by the transfer unit by heating the sheet, and a case housing the fixing rotary member pair;

a reverse rotary member pair disposed downstream of the fixing unit in a sheet conveyance direction, and capable of reversing and conveying the sheet;

a first conveyance path configured to guide the sheet from the fixing unit to the reverse rotary member pair;

a second conveyance path configured to guide the sheet reversed by the reverse rotary member pair to the fixing unit;

an opening and closing member supported in a manner swingable to a closed position closed with respect to an apparatus body and to an opening position opening the first conveyance path;

a first guide member supported by the opening and closing member to form one side of guide surfaces of the second conveyance path;

a second guide member supported by the opening and closing member, the second guide member forming an inserted portion where the case is inserted and another side of the guide surfaces of the second conveyance path, the second guide member forming one side of guide surfaces of the first conveyance path in a state where the opening and closing member is in the closed position, the second guide member being configured to allow visual recognition of the second conveyance path via the inserted portion in a state where the opening and closing member is in the opening position; and a dividing member, in the state where the opening and closing member is in the closed position, dividing a gap formed between the second guide member and the case inserted into the inserted portion from the second conveyance path.

2. The image forming apparatus according to claim 1, wherein, in the state where the opening and closing member is in the closed position, the case forms a part of the another side of the guide surfaces of the second conveyance path by being inserted into the inserted portion.

3. The image forming apparatus according to claim 2, further comprising a third conveyance path configured to guide the sheet from the transfer unit to the fixing unit, wherein the second guide member includes an upper guide and a lower guide, and forms the inserted portion between the upper guide and the lower guide, the upper guide forming the one side of the guide surfaces of the first conveyance path in the state where the opening and closing member is in the closed position, the lower guide being disposed below the upper guide in the state where the opening and closing member is in the closed position to form one side of guide surfaces of the third conveyance path.

4. The image forming apparatus according to claim 1, wherein the case includes a through hole configured to penetrate through an inner space of the case and the gap in the state where the opening and closing member is in the closed position to connect the inner space and the gap to each other, and wherein the dividing member divides the gap between the through hole and the second conveyance path.

5. The image forming apparatus according to claim 4, wherein the through hole is a first through hole, wherein the case includes a second through hole configured to penetrate through the inner space of the case and the gap in the state where the opening and closing member is in the closed position to connect the inner space and the gap to each other, wherein the first and second through holes are disposed such that longitudinal directions of the first and second through holes are along the sheet conveyance direction, and are disposed in parallel in a width direction orthogonally intersecting with the sheet conveyance direction, and wherein the dividing member has a width longer than a width in which the first and second through holes are disposed in parallel in the width direction.

6. The image forming apparatus according to claim 4, wherein the through hole is disposed above the fixing rotary member pair.

7. The image forming apparatus according to claim 1, wherein the dividing member is supported by one of the case and the second guide member, and comes into contact with another of the case and the second guide member in the state where the opening and closing member is in the closed position.

8. The image forming apparatus according to claim 7, wherein the dividing member includes a plate-shaped member having elasticity.

9. The image forming apparatus according to claim 7, wherein the dividing member is supported by the one of the case and the second guide member in a swingable manner.

10. The image forming apparatus according to claim 9, further comprising an urging member configured to urge the dividing member to the another of the case and the second guide member in the state where the opening and closing member is in the closed position.

11. The image forming apparatus according to claim 1, wherein the dividing member is disposed at a boundary between the gap and the second conveyance path.

12. The image forming apparatus according to claim 1, wherein the second guide member includes a first opening portion and a first ventilation portion, the first opening portion opening to the gap, the first ventilation portion communicating with the first opening portion to ventilate air flowing from the gap to an outside of the second guide member.

13. The image forming apparatus according to claim 12, wherein the second guide member includes a second opening portion opening to the second conveyance path and communicating with the first ventilation portion, and wherein the first guide member includes a third opening portion, a second ventilation portion, and a fourth opening portion, the third opening portion facing the second opening portion and opening to the second conveyance path, the second ventilation portion communicating with the third opening portion, the fourth opening portion communicating with the second ventilation portion to ventilate air flowing in the second ventilation portion to an outside of the first guide member.

14. The image forming apparatus according to claim 1, further comprising a conveyance rotary member pair disposed in the first conveyance path and configured to convey the sheet toward the reverse rotary member pair, the conveyance rotary member pair being in a contact state in a full width in a width direction orthogonally intersecting with the sheet conveyance direction in a state not conveying the sheet.

* * * * *